US011019980B2

(12) United States Patent
Disch et al.

(10) Patent No.: US 11,019,980 B2
(45) Date of Patent: Jun. 1, 2021

(54) CONVEYOR DISHWASHING MACHINE, AND METHOD FOR OPERATING A CONVEYOR DISHWASHING MACHINE

(71) Applicant: ILLINOIS TOOL WORKS INC., Glenview, IL (US)

(72) Inventors: Harald Disch, Elzach (DE); Beatrix Buchert, Ortenberg (DE); Martin Schrempp, Biberach (DE); Don E. Iles, Troy, OH (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 161 days.

(21) Appl. No.: 16/111,872

(22) Filed: Aug. 24, 2018

(65) Prior Publication Data

US 2020/0060507 A1 Feb. 27, 2020

(51) Int. Cl.

| | |
|---|---|
| ***A47L 15/24*** | (2006.01) |
| ***A47L 15/26*** | (2006.01) |
| ***A47L 15/42*** | (2006.01) |
| ***A47L 15/46*** | (2006.01) |

(Continued)

(52) U.S. Cl.

CPC ..... *A47L 15/241* (2013.01); *A47L 15/0021* (2013.01); *A47L 15/0078* (2013.01); *A47L 15/26* (2013.01); *A47L 15/4289* (2013.01); *A47L 15/46* (2013.01); *A47L 15/0055* (2013.01); *A47L 17/00* (2013.01);

(Continued)

(58) Field of Classification Search

CPC ..... A47L 15/241

See application file for complete search history.

(56) References Cited

U.S. PATENT DOCUMENTS

| | | | |
|---|---|---|---|
| 2,947,311 | A | 8/1960 | Fox et al. |
| 3,059,653 | A | 10/1962 | Ingolia |
| 3,288,154 | A | 11/1966 | Jacobs |

(Continued)

FOREIGN PATENT DOCUMENTS

| | | | |
|---|---|---|---|
| CN | 101203333 | A | 6/2008 |
| CN | 101366619 | | 2/2009 |

(Continued)

OTHER PUBLICATIONS

PCT, International Search Report and Written Opinion, International Application No. PCT/US2019/046817; dated Oct. 29, 2019, 16 pages.

*Primary Examiner* — Spencer E Bell

(74) *Attorney, Agent, or Firm* — Thompson Hine LLP

(57) ABSTRACT

A conveyor dishwashing machine (1) has at least one washing zone (7), and at least one final rinse zone (8) which is connected downstream (as viewed in the transport direction (T) of the wash items) of the at least one washing zone (7). The conveyor dishwashing machine (1) has a transport apparatus for transporting the wash items through the treatment zones (6, 7) of the conveyor dishwashing machine (1) so that the wash items are situated at least in regions in a washing plane (5) which runs horizontally. The washing plane (5) is configured as a main washing plane, and there is at least one additional washing plane (6) in at least one of the treatment zones (7, 8) of the conveyor dishwashing machine (1), in which additional washing plane (6) wash items can be treated at the same time as wash items in the main washing plane (5).

22 Claims, 5 Drawing Sheets

(51) Int. Cl.
*A47L 15/00* (2006.01)
*A47L 17/00* (2006.01)

(52) U.S. Cl.
CPC ..... *A47L 2301/04* (2013.01); *A47L 2401/04* (2013.01); *A47L 2501/07* (2013.01); *A47L 2501/36* (2013.01)

(56) References Cited

U.S. PATENT DOCUMENTS

| | | | |
|---|---|---|---|
| 4,088,145 | A | 5/1978 | Noren |
| 4,134,414 | A | 1/1979 | Jarvis et al. |
| 4,146,405 | A | 3/1979 | Timmer et al. |
| 5,934,298 | A | 8/1999 | Singh |
| 6,491,049 | B1 | 12/2002 | Tuller et al. |
| 8,043,437 | B1 | 10/2011 | Delgado et al. |
| 8,394,204 | B2 | 3/2013 | Buerkle et al. |
| 9,743,821 | B2 | 8/2017 | Baldwin et al. |
| 2004/0007256 | A1 | 1/2004 | Durazzani et al. |
| 2004/0244825 | A1 | 12/2004 | Ashton |
| 2006/0237047 | A1 | 10/2006 | Bigott |
| 2006/0260656 | A1 | 11/2006 | Riggleman |
| 2007/0023069 | A1 | 2/2007 | Golightly |
| 2007/0124004 | A1 | 5/2007 | King et al. |
| 2008/0035175 | A1 | 2/2008 | Varacins |
| 2008/0289655 | A1 | 11/2008 | Buerkle et al. |
| 2009/0151750 | A1 | 6/2009 | Ecker |
| 2011/0017234 | A1 | 1/2011 | Lehmann |
| 2011/0017235 | A1 | 1/2011 | Berner et al. |
| 2011/0094544 | A1 | 4/2011 | Fabin |
| 2011/0132403 | A1 | 6/2011 | Buerkle et al. |
| 2012/0031432 | A1 | 2/2012 | Beaudet et al. |
| 2012/0138092 | A1 | 6/2012 | Ashrafzadeh et al. |
| 2013/0056039 | A1 | 3/2013 | Hartz |
| 2013/0269736 | A1 | 10/2013 | Baldwin et al. |
| 2014/0000665 | A1 | 1/2014 | Graven et al. |
| 2015/0122290 | A1 | 5/2015 | Disch |
| 2016/0100737 | A1* | 4/2016 | Kramer ..... A47L 15/0031 134/58 D |
| 2016/0113478 | A1 | 4/2016 | Disch et al. |
| 2017/0071440 | A1 | 3/2017 | Berner et al. |
| 2017/0143182 | A1 | 5/2017 | Disch |
| 2017/0367557 | A1 | 12/2017 | Anim-Mensah et al. |
| 2018/0070795 | A1 | 3/2018 | Berner et al. |
| 2018/0199792 | A1 | 7/2018 | Berner |
| 2018/0206695 | A1 | 7/2018 | Disch |
| 2020/0163521 | A1 | 5/2020 | Disch |

FOREIGN PATENT DOCUMENTS

| | | |
|---|---|---|
| CN | 101925322 | 12/2010 |
| CN | 101998839 | 3/2011 |
| CN | 102105093 | 6/2011 |
| CN | 102137613 A | 7/2011 |
| CN | 201987507 | 9/2011 |
| CN | 201987507 U | 9/2011 |
| CN | 201987508 | 9/2011 |
| CN | 102512128 | 6/2012 |
| CN | 203016901 | 6/2013 |
| CN | 103565384 | 2/2014 |
| CN | 203970954 | 12/2014 |
| CN | 104352209 | 2/2015 |
| CN | 205758400 | 12/2016 |
| CN | 205758480 | 12/2016 |
| DE | 2304035 | 8/1974 |
| DE | 10004454 | 8/2001 |
| DE | 10058410 | 9/2002 |
| DE | 102004046758 | 4/2006 |
| DE | 10 2005 023 429 | 11/2006 |
| DE | 60030582 | 9/2007 |
| DE | 102006062071 | 7/2008 |
| DE | 20 2009 004 771 | 9/2010 |
| DE | 102011054150 | 6/2012 |
| DE | 102011084917 | 4/2013 |
| DE | 102013101661 | 10/2013 |
| DE | 102012207565 | 11/2013 |
| DE | 20 2014 010 365 | 5/2015 |
| DE | 10 2015 203 127 | 9/2015 |
| DE | 102014208813 | 11/2015 |
| DE | 102015111883 | 1/2017 |
| DE | 102015111994 | 1/2017 |
| EP | 1723887 | 11/2006 |
| EP | 1790274 | 5/2007 |
| EP | 2491844 | 8/2012 |
| FR | 1480946 | 5/1967 |
| FR | 2640487 | 6/1990 |
| GB | 1248159 | 9/1971 |
| JP | H 0975290 A | 3/1997 |
| JP | 2000 166849 | 6/2000 |
| JP | 2002253470 | 9/2002 |
| WO | WO 01/93741 | 12/2001 |
| WO | WO 2011/128804 | 10/2011 |
| WO | WO 2013/090443 | 6/2013 |
| WO | WO 2013169548 | 11/2013 |
| WO | WO 2014/186182 | 11/2014 |
| WO | WO 2015/138545 | 9/2015 |
| WO | WO 2017/015254 | 1/2017 |
| WO | WO 2017/015256 | 1/2017 |
| WO | WO 2017015254 | 1/2017 |
| WO | WO 2017015256 | 1/2017 |

* cited by examiner

CONVEYOR DISHWASHING MACHINE, AND METHOD FOR OPERATING A CONVEYOR DISHWASHING MACHINE

TECHNICAL FIELD

The present invention relates to a conveyor dishwashing machine in accordance with the preamble of patent claim 1.

Accordingly, the invention relates, in particular, to a conveyor dishwashing machine having at least one washing zone and at least one final rinse zone which is connected downstream of the at least one washing zone, as viewed in the transport direction of the wash items to be treated in the conveyor dishwashing machine. In the at least one washing zone of the conveyor dishwashing machine, washing liquid is sprayed onto the wash items to be treated in the conveyor dishwashing machine or can be sprayed there onto the wash items to be treated. In the final rinse zone which is connected downstream of the at least one washing zone, final rinse liquid is sprayed onto the wash items to be treated in the conveyor dishwashing machine or final rinse liquid can be sprayed onto the wash items to be treated in the conveyor dishwashing machine.

Furthermore, the conveyor dishwashing machine according to the invention optionally has at least one drying zone which is connected downstream (as viewed in the transport direction of the wash items) of the at least one final rinse zone and in which the wash items to be treated in the conveyor dishwashing machine are dried or can be dried at least partially.

Furthermore, the conveyor dishwashing machine has a transport apparatus for transporting the wash items to be treated in the respective treatment zones of the conveyor dishwashing machine through the treatment zones of the conveyor dishwashing machine, to be precise in such a way that the wash items to be treated in the treatment zones are situated at least in regions in a washing plane which runs, in particular, horizontally.

A conveyor dishwashing machine in accordance with the present invention is, in particular, a belt conveyor dishwashing machine or a basket conveyor dishwashing machine.

BACKGROUND

Conveyor dishwashing machines of the type mentioned at the outset are known in principle from the prior art are usually used in the commercial sector.

In contrast to what are known as stationary rack machines, in which the wash items to be cleaned remain in a stationary location in the machine during the cleaning, transporting of the wash items through different treatment zones of the conveyor dishwashing machine takes place in the case of conveyor dishwashing machines.

As treatment zones, a conveyor dishwashing machine usually has at least one prewashing zone and at least one main washing zone which is arranged downstream of the prewashing zone/zones as viewed in the transport direction of the wash items. At least one final rinse zone is as a rule arranged downstream of the prewashing zone/zones as viewed in the transport direction.

It is also known to also provide at least one postwashing zone or prerinse zone between the main washing zone and the final rinse zone. As viewed in the transport direction of the wash items, the wash items which are either received directly onto a transport belt or are held by way of wash baskets usually runs through an entry tunnel, the adjoining zone/zones, main washing zone/zones, possibly provided postwashing zone/zones, final rinse zone/zones and drying zone/zones into an exit section.

Said washing zones (prewashing zone, main washing zone and possibly provided postwashing zone) of the conveyor dishwashing machine are in each case assigned a washing system which has a washing pump and a line system which is connected to the washing pump and via which washing liquid is fed to corresponding spray nozzles of the washing zone. The washing liquid which is fed to the spray nozzles is sprayed in the respective washing zone onto the wash items which are transported by a transport apparatus of the conveyor dishwashing machine through the respective washing zones in the washing plane which runs, in particular, horizontally.

Each washing zone is assigned a washing tank, in which sprayed liquid is received and/or in which liquid for the spray nozzles of the relevant treatment zone is provided.

In the case of the conveyor dishwashing machines which are known from the prior art, final rinse liquid in the form of fresh water which can be pure or mixed with further additives, such as final rinse agent, is sprayed onto the wash items via the spray nozzles of the final rinse zone. At least part of the sprayed final rinse liquid is transported via a cascade system counter to the transport direction of the wash items from treatment zone to treatment zone.

The sprayed final rinse liquid is collected in a tank (postwashing tank) of the postwashing zone, from which tank it is conveyed to the spray nozzles (postwashing nozzles) of the postwashing zone via the washing pump of the washing system which belongs to the postwashing zone. Washing liquid is rinsed from the wash items in the postwashing zone. The liquid which accrues here flows into the washing tank of the at least one main washing zone which is connected upstream of the postwashing zone as viewed in the transport direction of the wash items. Here, the liquid is usually provided with a cleaning agent and is sprayed onto the wash items via the nozzles (washing nozzles) of the main washing zone by way of a pump system (washing pump system) which belongs to the washing system of the main washing zone.

From the washing tank of the main washing zone, provided that no further main washing zone is provided, the liquid subsequently flows into the prewashing tank of the prewashing zone. The liquid in the prewashing tank is sprayed onto the wash items via the prewashing nozzles of the prewashing zone by way of a pump system which belongs to the washing system of the prewashing zone, in order to remove coarse impurities from the wash items.

Almost without exception, commercial dishwashing machines which are configured as conveyor dishwashing machines are configured with feed/outlet tables. Manual preliminary clearing and possibly manual prewashing of the dirty wash items which are to be treated in the conveyor dishwashing machine usually takes place on the feed side of the conveyor dishwashing machine. Furthermore, the loading of the dirty wash items into (special) wash baskets as a rule takes place here, if the conveyor dishwashing machine is configured as a basket conveyor dishwashing machine.

The outlet side of the conveyor dishwashing machine with the correspondingly associated outlet table serves as a rule for drying and unloading of the wash baskets.

In the case of conveyor dishwashing machines, in particular, the washing plane of the conveyor dishwashing machine is usually situated at the same level as the feed and outlet tables which are assigned to the conveyor dishwashing machine. In this way, for example, the wash baskets to be cleaned can be pushed simply and ergonomically from the feed table into the dishwashing machine and, after cleaning has ended, out of the dishwashing machine onto the outlet table.

The term "washing plane" which is used here is to be understood to mean the horizontal plane, in which the wash items which are to be transported through the individual treatment zones of the conveyor dishwashing machine are situated at least in regions or (if the conveyor dishwashing machine is configured as a basket conveyor dishwashing machine) in which the wash basket lies. In the corresponding treatment zones of a conveyor dishwashing machine, the washing plane is as a rule fixed by a guide system, in particular guide rails, by way of which wash items can be transported through the treatment zones of the conveyor dishwashing machine with the aid of the transport apparatus.

Commercial conveyor dishwashing machines are designed, in particular, to clean large quantities of wash items in as short a time as possible. For instance, in the case of a basket conveyor dishwashing machine from the present applicant, the theoretical capacity of a preset standard program which is usually used for normally soiled wash items, such as plates, bowls, cups, glasses, etc., is from 80 to 320 wash baskets per hour depending on the model.

Depending on the wash items (wash item type) and/or their degree of soiling, it can be necessary, however, to adapt the treatment parameters in the corresponding treatment zones of the conveyor dishwashing machine and, for example, to reduce the transport speed, in order to make a longer dwell time of greatly soiled wash items possible in this way, for example in the at least one washing zone of the conveyor dishwashing machine, and therefore to ensure a perfect cleaning result even in the case of very pronounced soiling.

Thus, for example, basket conveyor dishwashing machines from the present applicant as a rule have different transport speeds, as a result of which it is made possible to select a slower transport speed in order to improve the cleaning result specifically of heavily soiled wash items, such as pots, GN containers or cutlery. As a result, however, the capacity for all the remaining less heavily soiled wash items which might be cleaned even at a faster transport speed is also reduced.

In practice, this leads to what is known as an intensive program being selected only rarely by the operator of the conveyor dishwashing machine despite improved washing performance, since the correspondingly slower transport speed is perceived as too slow, specifically at peak times, that is to say in the case of an increased volume of crockery. Instead, the heavily soiled wash items (cutlery, pots, pans, GN containers, etc.) is usually likewise treated at the faster transport speed in the treatment zones of the conveyor dishwashing machine, and the lower washing performance which is achieved as a result is compensated for by way of additional manual working steps, such as manual prewashing of heavily soiled GN containers or separate presoaking of cutlery.

Depending on the wash items and/or the wash item type and their degree of soiling, it can be necessary, in particular, to set treatment parameters for the treatment of the wash items in the corresponding treatment zones of the conveyor dishwashing machine, which treatment parameters ensure a particularly intensive treatment, for example a longer time duration in a treatment zone, a higher temperature of the washing/rinse liquid and/or a greater mechanical washing action, in order to achieve a perfect cleaning result at the end.

For instance, it is known from the prior art in this context that commercial conveyor dishwashing machines have, for example, different treatment programs and, in particular, intensive treatment programs, in order to improve the cleaning result specifically of heavily soiled wash items. In comparison with a standard treatment program, an intensive treatment program of this type lasts for a considerably longer time for a passage through the individual treatment zones, with the result that the capacity of the conveyor dishwashing machine is reduced greatly in the case of a selected intensive treatment program, since the individual treatment zones of the machine are then occupied for a considerably longer time than would be the case in a standard treatment program.

SUMMARY

On the basis of this depiction of the problem, the invention is based on the object of developing a conveyor dishwashing machine of the type mentioned at the outset, in such a way that the capacity of the conveyor dishwashing machine can be improved even when treatment parameters or treatment programs are selected for the treatment of the wash items, which treatment parameters or treatment programs lead to a longer dwell time of the wash items to be treated in the treatment zones of the dishwashing machine than would be the case in a customary standard treatment program.

Said object is achieved by way of the subject matter of independent patent claim 1, advantageous developments of the solution according to the invention being specified in the dependent patent claims.

Accordingly, a dishwashing machine is proposed in accordance with the invention having at least one washing zone, in which washing liquid is sprayed or can be sprayed onto the wash items which are to be treated in the conveyor dishwashing machine, and having at least one final rinse zone which is connected downstream (as viewed in the transport direction of the wash items) of the at least one washing zone and in which final rinse liquid is sprayed or can be sprayed onto the wash items. Furthermore, the conveyor dishwashing machine according to the invention optionally has at least one drying zone which is connected downstream (as viewed in the transport direction of the wash items) of the at least one final rinse zone and in which the wash items are dried or can be dried at least partially.

The conveyor dishwashing machine according to the invention has a transport apparatus, in order to transport the wash items which are to be treated in the conveyor dishwashing machine through the treatment zones of the conveyor dishwashing machine in such a way that the wash items which are to be treated in the treatment zones are situated at least in regions in a washing plane which runs, in particular, horizontally.

It is provided according to the invention, in particular, that the washing plane which runs, in particular, horizontally is configured as a main washing plane, there being, in addition to the main washing plane, at least one additional washing plane in at least one of the treatment zones of the conveyor dishwashing machine, in which at least one additional washing plane wash items can be treated at the same time as wash items in the main washing plane.

In this context, it is provided, in particular, that the conveyor dishwashing machine is configured in such a way that wash items can be treated in the main washing plane and in the at least one additional washing plane at the same time and in parallel, but, in particular, with different treatment parameters.

The term "can be treated independently of one another" which is used here can be understood to mean, in particular, the treatment zone-specific treatment of the wash items with regard to the exposure time, the mechanical washing and/or rinse action and/or with regard to the selected treatment parameters.

In other words, it is provided according to the invention, in particular, to divide at least one treatment zone of the conveyor dishwashing machine into two regions, it being possible for at least part of the parameters which characterize the treatment of the wash items in said at least one treatment zone (such as the exposure time, the mechanical washing and/or rinse action, the temperature and/or a composition of the washing/final rinse liquid, etc.) to be set individually for each region of said at least one treatment zone.

Here, one region of the at least two regions of the at least one treatment zone lies in the region of the main washing plane, whereas the at least one further region of said at least one treatment zone lies in the region of the at least one additional washing plane.

It is conceivable in this context for the at least two regions of the at least one treatment zone to be of spatially separate configuration from one another. Said embodiment has the advantage, in particular, that completely different treatment programs and treatment parameters can be selected for the corresponding regions of the at least one treatment zone of the conveyor dishwashing machine. It is conceivable in this context, for example, that treatment is carried out in accordance with a standard treatment program or in accordance with standard treatment parameters in that region of the at least one treatment zone, in which the main washing plane falls, whereas the wash items are treated, for example, in accordance with an intensive treatment program or in accordance with corresponding intensive treatment parameters in another region of the at least one treatment zone, which region is spatially separate, in particular, from said former region.

The spatially separate embodiment of the at least two regions of the at least one treatment zone also entails the further advantage that the at least two regions of the treatment zone can be configured independently of one another with regard to the loading and unloading or feeding and discharging of wash items.

Secondly, the present invention is not restricted to conveyor dishwashing machines, in the case of which at least one treatment zone of the conveyor dishwashing machine is divided into at least two regions which are separated spatially (hermetically) from one another with the aid of a partition. Rather, it is provided in accordance with one aspect of the present invention to configure the at least two regions of the at least one treatment zone within a common treatment zone, and, in particular, not to provide any spatial separation between the at least two regions.

In order that, in accordance with said aspect of the present invention, the wash items can nevertheless be treated differently in the different regions of the at least one treatment zone, it is provided in accordance with preferred embodiments of the invention that the dishwashing machines are configured with treatment systems (in particular, washing and/or rinse systems) which are separate with regard to the respective regions of the at least one treatment zone.

If, for example, the corresponding treatment systems are configured as washing systems (and therefore the corresponding treatment zone is configured as a washing zone), it is appropriate if each region of the washing zone has a correspondingly associated washing pump for independently feeding washing liquid which has collected in the washing tank of the dishwashing machine to the corresponding nozzle arrangements in the respective regions of said treatment zone (washing zone). In particular, the mechanical action (nozzle pressure) can be set individually in the different regions by way of separately configured washing systems of this type.

It is thus conceivable, for example, that the washing nozzles which are directed onto the at least one additional washing plane are loaded with a higher nozzle pressure in comparison with the washing nozzles which are directed in the washing zone with regard to the main washing plane.

With regard to the at least one final rinse zone, it is also conceivable as an alternative or in addition in this respect to divide the at least one final rinse zone into at least two regions, the corresponding final rinse nozzles being directed onto the main washing plane in a first region, the corresponding final rinse nozzles being directed with regard to the at least one additional washing plane in the at least one further (second) region of the final rinse zone. It is also conceivable here again for each region to be assigned a separate final rinse system, in order to carry out the final rinse in an individual and washing plane-specific manner.

Even in the case of embodiments of the type, in which the at least two regions of a treatment zone of the conveyor dishwashing machine are not separated spatially and/or hermetically from one another, it goes without saying that it is likewise conceivable that the treatment of the wash items in the different regions takes place with different exposure times. This is possible, in particular, even when one and the same treatment program is selected for the two regions of the corresponding treatment zone of the conveyor dishwashing machine. In this context, it is conceivable, for example, that, in a region of the corresponding treatment zone, in particular in that region of the treatment zone which is assigned to the main washing plane, wash items are transported at the standard transport speed through the corresponding region and therefore dwell for a defined time duration in the region of at least one treatment zone, whereas, in the other region of the corresponding treatment zone, the wash items are transported through said region at a different, in particular slower transport speed or remain in a stationary manner, with the result that the wash items remain for a longer dwell time in said other region of the treatment zone which is assigned, in particular, to the at least one additional washing plane, as a consequence of which the exposure time can be multiplied correspondingly.

It is particularly preferably provided that, in the case of the conveyor dishwashing machine according to the invention, the main washing plane lies in a horizontal plane, in which the table plane/table planes of a feed and/or outlet table which are/is assigned to the conveyor dishwashing machine lies/lie. It is appropriate here if the at least one additional washing plane lies in a plane which is spaced apart vertically from the plane, in which the main washing plane runs, the at least one additional washing plane lying, in particular, above and/or below the main washing plane as viewed in the horizontal direction.

Said embodiments, in which the washing planes (main washing plane and at least one additional washing plane) are arranged, in particular, above one another, make it possible firstly that the horizontal washing plane which corresponds to the main washing plane is preferably aligned with the table plane of a feed or outlet table of the conveyor dishwashing machine, whereas secondly the "footprint" of the conveyor dishwashing machine, that is to say that region in the scullery which is required for setting up the conveyor dishwashing machine, preferably remains unchanged in comparison with a (conventional) conveyor dishwashing machine, in the case of which merely one (main) washing plane is provided.

In accordance with embodiments of the conveyor dishwashing machine according to the invention, it is provided that the conveyor dishwashing machine is configured in such a way that wash items can be fed to the main washing plane and to the at least one additional washing plane via a common opening, and/or that wash items can be removed from the main washing plane and the at least one additional washing plane via a common opening.

In the case of said embodiment, in particular, it is appropriate if a corresponding loading and/or unloading apparatus is provided, in order to transfer wash items from a horizontal plane, in which the main washing plane also lies, into the at least one additional washing plane, or in order to transfer wash items from the at least one additional washing plane into a horizontal plane, in which the main washing plane also lies. Said loading and/or unloading apparatus can have, for example, a mechanism, in order to retract or extend a wash basket into or out of the at least one additional washing plane as required.

It would be conceivable, for example, that the mechanism for retracting or extending a wash basket as required has a lifting unit, with the aid of which a wash basket which is situated in a horizontal plane, in which the main washing plane also lies, can be transferred into the horizontal plane, in which the at least one additional washing plane lies. Said lifting unit can have, for example, a linear drive and can be configured to transfer the wash basket in a linear movement from the main washing plane into the at least one additional washing plane and vice versa.

As an alternative or in addition to this, the mechanism for transferring a wash basket into the additional washing plane as required can have a pivoting unit, with the aid of which a wash basket which is provided in the horizontal plane, in which the main washing plane also lies, can be transferred, in particular, in a superimposed linear and pivoting movement into the horizontal plane, in which the at least one additional washing plane lies.

In accordance with embodiments of the solution according to the invention, it is provided that the main washing plane of the conveyor dishwashing machine is assigned an opening, via which wash items can be fed to and/or removed from the main washing plane, the at least one additional washing plane being assigned an opening which is separate from the opening of the main washing plane, with the result that the main washing plane and the at least one additional washing plane can be loaded and/or unloaded independently of one another.

In this context, it is conceivable, for example, that wash items can be fed into the at least one additional washing plane via a separate door opening, the door leaf assuming the function of a loading and/or unloading apparatus in the swung-out state, and to preferably transfer the wash items or a wash basket in a linear movement from a horizontal plane, in which the main washing plane also lies, into a horizontal plane (and vice versa), in which horizontal plane the at least one additional washing plane also lies.

In the following text, different embodiments of the present invention will be summarized briefly:

In accordance with one embodiment, the invention relates to an automatic cleaning unit, in particular to a commercial single-tank or multiple-tank dishwashing machine, such as a programmable machine or a dishwashing machine with a transport system (such as a basket conveyor dishwashing machine or belt conveyor dishwashing machine), at least one second (further) washing plane being situated in the machine on a working plane (table height or table level) in addition to the main washing plane.

In this context, it is conceivable, for example, that the second washing plane which is called an additional washing plane is situated below the main washing plane, whereas the main washing plane is arranged at table height.

As an alternative to this, it is conceivable if the additional washing plane is situated above and/or to the side of the main washing plane.

BRIEF DESCRIPTION OF THE DRAWINGS

In the following text, the invention will be described in greater detail with reference to the exemplary embodiments which are shown in the drawings.

In the drawings.

DETAILED DESCRIPTION

Figure 1A:
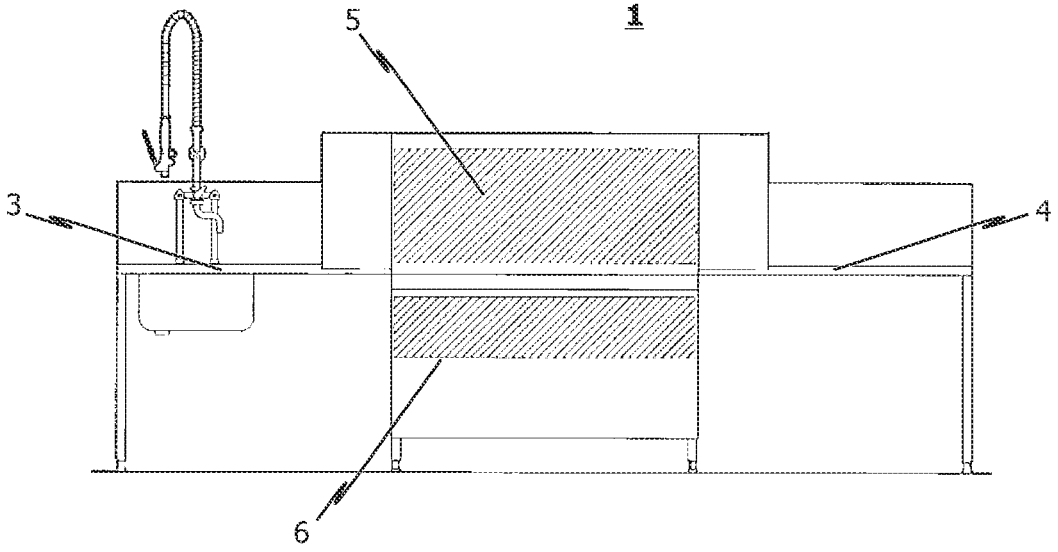
FIG. 1A diagrammatically shows a first exemplary embodiment of the conveyor dishwashing machine according to the invention, FIG. 1B diagrammatically shows a second exemplary embodiment of the conveyor dishwashing machine according to the invention, FIG. 2 diagrammatically shows a hydraulic diagram of a third exemplary embodiment of the conveyor dishwashing machine according to the invention, FIG. 3 diagrammatically shows a hydraulic diagram of a fourth exemplary embodiment of the conveyor dishwashing machine according to the invention, FIG. 4 diagrammatically shows a hydraulic diagram of a fifth exemplary embodiment of the conveyor dishwashing machine according to the invention, and FIG. 5 diagrammatically shows a hydraulic diagram of a sixth exemplary embodiment of the conveyor dishwashing machine according to the invention.

FIG. 1A diagrammatically shows a side view of a first exemplary embodiment of the dishwashing machine 1 according to the invention. As shown, it is advantageous from an ergonomic aspect if the conveyor dishwashing machine 1 (in particular, if it is configured as a basket conveyor dishwashing machine) is equipped in each case with a table (feed table 3, outlet table 4) on its feed and outlet side. The wash baskets which are loaded with dirty wash items can therefore be pushed into the dishwashing machine 1 on the feed table 3. After the treatment of the wash items in the at least one treatment zone of the dishwashing machine 1, the wash basket with the wash items which are then cleaned is moved out of the machine onto the outlet table 4.

The exposure time, that is to say the time during which cleaning or washing liquid wets the wash items within the at least one treatment zone of the conveyor dishwashing machine 1, is dependent, in particular, on the transport speed, at which the wash items are transported through the treatment zone, and the length of the treatment zone. For normally soiled wash items, such as plates, bowls, cups and/or glasses, it is a rule sufficient if the wash items to be treated are treated for from 50 to 100 seconds in the at least one washing zone of the conveyor dishwashing machine 1. A longer treatment of the wash items can be necessary, however, in particular if said wash items have a greater degree of soiling, or if dirt is burned into the wash items. Extension of the overall treatment time in the washing zone to up to 400 seconds is then frequently required. This is achieved as a rule by way of a corresponding reduction of the transport speed, at which the wash items are transported through the washing zone. The wash items to be cleaned are subjected to an intensive treatment by way of the extended exposure time, with the result that even wash items which are soiled to a relatively great extent can be cleaned effectively.

In order to ensure that, despite an intensive treatment, the cleaning capacity of the conveyor dishwashing machine 1, that is to say the wash item units/wash item baskets which can be processed theoretically by the conveyor dishwashing machine 1 per unit time, is not influenced negatively, it is provided in accordance with the invention that the conveyor dishwashing machine 1 has at least two washing planes (main washing plane 5 and at least one further additional washing plane 6), it being possible for wash items to be treated simultaneously in said at least two washing planes 5, 6.

In particular, it is provided in accordance with advantageous realizations of the conveyor dishwashing machine 1 according to the invention that said conveyor dishwashing machine 1 is configured in such a way that wash items can be treated in the main washing plane 5 and in the at least one additional washing plane 6 at the same time and in parallel, but with different treatment parameters. Said treatment parameters are, for example, an exposure time, a mechanical washing and/or rinsing action, a temperature and/or a chemical composition of a washing/rinsing liquid.

In accordance with the exemplary embodiment (shown diagrammatically in FIG. 1A) of the conveyor dishwashing machine 1 according to the invention, it is provided that the main washing plane 5 lies in a horizontal plane, in which the table planes of the feed and outlet tables 3, 4 which are assigned to the conveyor dishwashing machine 1 also lie. Here, the additional washing plane 6 is arranged below the main washing plane 5, that is to say below the washing plane at table level.

It can be achieved in this way that the overall height of the conveyor dishwashing machine 1 remains unchanged, despite the additional washing plane.

Figure 1B:
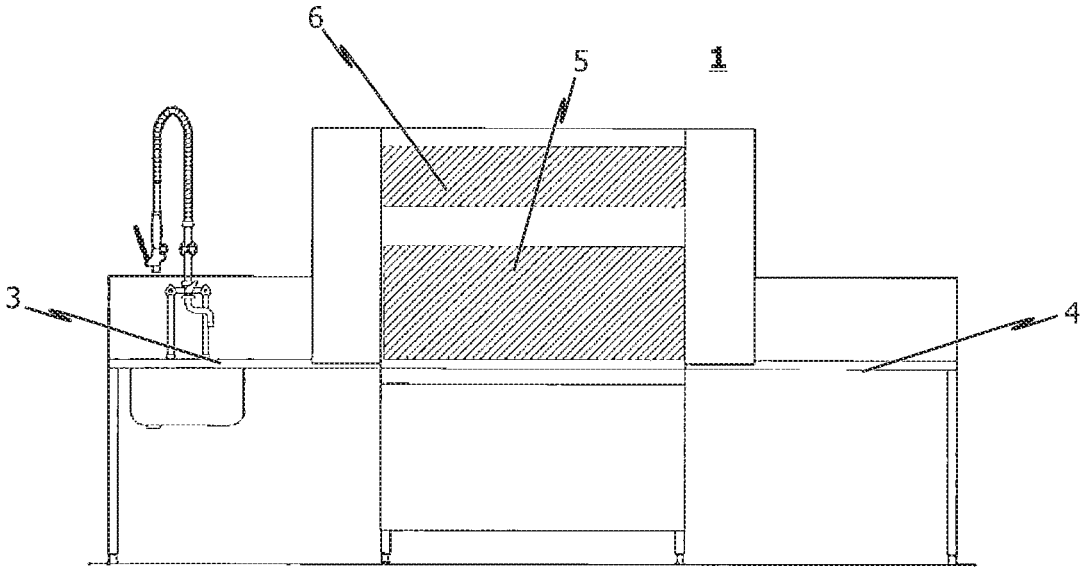

As an alternative to the embodiment which is shown in FIG. 1A, it is also conceivable in accordance with the diagrammatic drawing in FIG. 1B, however, to arrange the second washing plane (that is to say, the additional washing plane 6) above the main washing plane 5.

In the following text, different embodiments of the exemplary conveyor dishwashing machine 1 will be described with reference to the hydraulic diagrams in accordance with FIGS. 2 to 5.

A common feature of said embodiments is that, as indicated in FIG. 1A, the at least one additional washing plane 6 is below the main washing plane 5 which lies at the table level of the feed and outlet tables 3, 4 which are assigned to the conveyor dishwashing machine 1. It goes without saying that this is not to be understood as a restriction. Rather, it is also conceivable to apply the aspects which are described in the following text with reference to the illustrations in FIGS. 2 to 5 to a conveyor dishwashing machine 1 in accordance with the illustration in FIG. 1B.

The exemplary embodiments of the conveyor dishwashing machine 1 according to the invention in accordance with the hydraulic diagrams in FIG. 2 to FIG. 5 in each case have a transport apparatus (not shown) for transporting wash items (likewise not shown) in a transport direction T through the conveyor dishwashing machine 1. The conveyor dishwashing machine 1 has at least one washing zone 7, for example precisely one washing zone 7 as indicated in FIGS. 2 to 5.

However, it is also conceivable for the conveyor dishwashing machine 1 to have additional washing zones, in particular at least one prewashing zone and a main washing zone.

In accordance with the embodiments which are shown in FIGS. 2 to 5, a final rinse zone 8 is arranged downstream of the washing zone 7 as viewed in the transport direction T. It is also conceivable here that further cleaning zones are provided between the washing zone 7 and the final rinse zone 8, for example a postwashing zone or pump final rinse zone (prerinsing zone).

In the case of the conveyor dishwashing machines 1 which are considered herein, the final rinse zone 8 can also be adjoined by a drying zone as viewed in the transport direction T of the wash items, although this is not absolutely necessary.

It is fundamentally appropriate, however, to separate the respective zones of the conveyor dishwashing machine 1 (here, the washing zone 7 and fresh water final rinse zone 8) from one another via corresponding dividing curtains. In addition or as an alternative, it is also advantageous if the entry tunnel of the conveyor dishwashing machine 1 itself is separated from the inlet of the machine via a dividing curtain.

The provision of dividing curtains of this type prevents overspraying of washing liquid and final rinse liquid and the discharge of vapors from the conveyor dishwashing machine 1.

Said treatment zones of the conveyor dishwashing machine 1 are assigned spray nozzles. Said spray nozzles serve to spray liquid onto the wash items when they are transported by the transport apparatus through the respective treatment zones. The individual spray systems of the treatment zone ensure that the wash items to be treated are sprayed both from the upper side and from the lower side.

Although not shown in FIGS. 2 to 5, it is advantageous in this context if the fresh water final rinse zone 8 has not only downwardly directed upper spray nozzles and upwardly directed lower spray nozzles, but rather also transversely directed lateral spray nozzles on each side of the transport apparatus. The use of lateral spray nozzles of this type makes targeted spraying of the wash item surfaces (crockery surfaces) with final rinse liquid possible, even in obscured zones. This provides a clear advantage with regard to the final rinse result (effective rinsing of cleaning agent residues on wash item surfaces, even in obscured zones) in comparison with systems, in the case of which only upper and lower spray nozzles and no transversely directed lateral spray nozzles are provided in the final rinse zone 8.

As shown in FIGS. 2 to 5, it is provided in the case of the exemplary embodiments of the conveyor dishwashing machine 1 according to the invention that the washing zone 7 (here, the single washing zone 7) is assigned a tank (washing tank 9) which serves to receive sprayed liquid and/or to provide liquid for the washing nozzles of the washing zone 7.

In the case of the conveyor dishwashing machines 1 which are shown diagrammatically in FIGS. 2 to 5, final rinse liquid which is composed of fresh water with final rinse agent which is metered in is sprayed onto the wash items (not shown in the drawings) via the spray nozzles of the final rinse zone 8 which are arranged laterally, and above and below the transport apparatus. At least part of the sprayed liquid runs counter to the transport direction T of the wash items from the final rinse zone 8 to the (here, single) washing zone 7.

If a plurality of washing zones are provided, it is appropriate to provide a cascade system, via which part of the final rinse liquid which is sprayed in the final rinse zone 8 is transported from treatment zone to treatment zone counter to the transport direction T of the wash items.

The liquid which is received by the washing tank 9 of the washing zone 7 is usually provided with a cleaning agent and is sprayed onto the wash items via the spray nozzles of the main washing zone 5 with the aid of a washing pump. The washing liquid which is sprayed by way of the washing nozzles flows back into the washing tank 9 as a result of gravity.

As has already been indicated, the liquid which is sprayed in the washing zone 7 preferably contains cleaning agent which is metered, for example, into the liquid which is received in the washing tank 9 of the washing zone 7, with the aid of a cleaning agent metering apparatus (not shown in the drawings).

The washing tank 9 is provided with an overflow line which serves to discharge the excess quantity of liquid if a liquid level is exceeded in the washing tank 9. In this context, it is conceivable to use the excess quantity of liquid for manual preliminary clearing on the inlet side of the conveyor dishwashing machine 1 and/or to feed said excess quantity of liquid to a heat generation device, in order to recover thermal energy of the waste water.

Furthermore, the washing tank 9 is provided with an outflow line which opens at a lower end region of the washing tank 9 and can be closed via a valve.

If the washing tank 9 is empty or is filled only insufficiently before a first start of the conveyor dishwashing machine 1, said washing tank 9 has to first of all be filled via either a fresh water line and/or by way of final rinse liquid being sprayed in the final rinse zone 8.

It is fundamentally conceivable that, as viewed in the transport direction T of the wash items, the final rinse zone 8 is adjoined by a drying zone, in which the wash items are dried by way of dry and heated air, in order to blow off or dry off the moisture which is situated on the wash items. In the case of the exemplary embodiments in accordance with FIGS. 2 to 5, however, a drying zone of this type is not provided; rather, the finally rinsed wash items dry on the outlet table 4 outside the conveyor dishwashing machine 1.

As has already been indicated, the exemplary embodiments in accordance with FIGS. 2 to 5 are distinguished by the fact that at least the washing zone 7 has two washing planes 5, 6 in the case of said conveyor dishwashing machines 1. The two washing planes 5, 6 are configured in such a way that wash items can be treated in them at the same time and in parallel, to be precise optionally also with different treatment parameters, such as for instance with a different exposure time, a different mechanical washing action, temperature and different chemical composition of the washing liquid.

In this way, it is possible that the wash items are subjected to an intensive treatment in one of the washing planes 5, 6, whereas a standard treatment of the wash items takes place in the other washing plane 6, 5, with the result that the cleaning capacity of the dishwashing machine 1 can be increased considerably in every case.

Although the exemplary embodiments of the conveyor dishwashing machine 1 according to the invention which are shown in the drawings are configured in each case with precisely two washing planes 5, 6, this is not to be considered restrictive. Rather, it goes without saying that it is also conceivable that the washing zone 7 and/or the final rinse zone 8 of the dishwashing machine 1 according to the invention are/is divided into more than two washing planes.

In the case of the conveyor dishwashing machines 1 which are shown diagrammatically in FIGS. 2 to 5, a further washing plane 6 is provided in addition to the usually provided main washing plane 5, which further washing plane 6 is arranged below the main washing plane 5 here.

The upper main washing plane 5 is configured such that a wash basket can be pushed/pulled from a feed table 3 (not shown in FIGS. 3 to 5) directly into the washing zone 7 of the conveyor dishwashing machine 1 with the aid of a transport apparatus or manually. In other words, the main washing plane 5 is oriented in the horizontal direction at the table level of the feed table 3.

Furthermore, an outlet table 4 is provided in a preferable way, the table level of the outlet table 4 likewise being aligned horizontally with the main washing plane 5, with the result that, after the treatment in the treatment zones of the conveyor dishwashing machine 1, the wash basket can be transported directly onto the outlet table 4.

As has already been indicated, a further washing plane (additional washing plane 6) is provided below the main washing plane 5. Said additional washing plane is designed to receive at least one wash basket, the wash items which are to be treated in the additional washing plane 6 being received in the wash basket.

The conveyor dishwashing machine 1 with the at least two washing planes is preferably configured such that wash items can be fed to both the main washing plane 5 and the at least one additional washing plane 6 via a common opening, and/or wash items can be removed from the main washing plane 5 and the at least one additional washing plane 6 via a common opening. In this context, it is appropriate if the common opening is oriented with regard to the main washing plane 5, it being possible for the wash items or the wash basket to be transferred as required from the main washing plane 5 into the additional washing plane 6 with the aid of a loading/unloading device.

As an alternative to this, however, it is also conceivable if the main washing plane 5 is assigned an opening, via which wash items can be fed to and/or removed from the main washing plane 5, and the at least one additional washing plane 6 being assigned an opening which is separate from the opening of the main washing plane 5, with the result that the main washing plane 5 and the at least one additional washing plane 6 can be loaded and/or unloaded independently of one another. In this case, a corresponding loading and/or unloading apparatus for transferring wash items or wash baskets from the main washing plane 5 to the at least one additional washing plane 6 might possibly be dispensed with.

In the case of the embodiments which are shown in FIGS. 2 to 5, it is provided that the additional washing plane 6 is provided only in the region of the washing zone 7. It goes without saying, however, that this is not to be considered restrictive.

In other words, in the region of the final rinse zone 8 (fresh water final rinse zone 8), the wash items to be treated or the wash item baskets to be treated are fundamentally treated in one and the same washing plane which coincides with the main washing plane 5. Therefore, in the case of the embodiments which are shown in FIGS. 2 to 5, only a single final rinse system is also provided, consisting of the spray nozzles, a fresh water heater, for example in the shape of a boiler, and possibly a final rinse pump.

Figure 2:
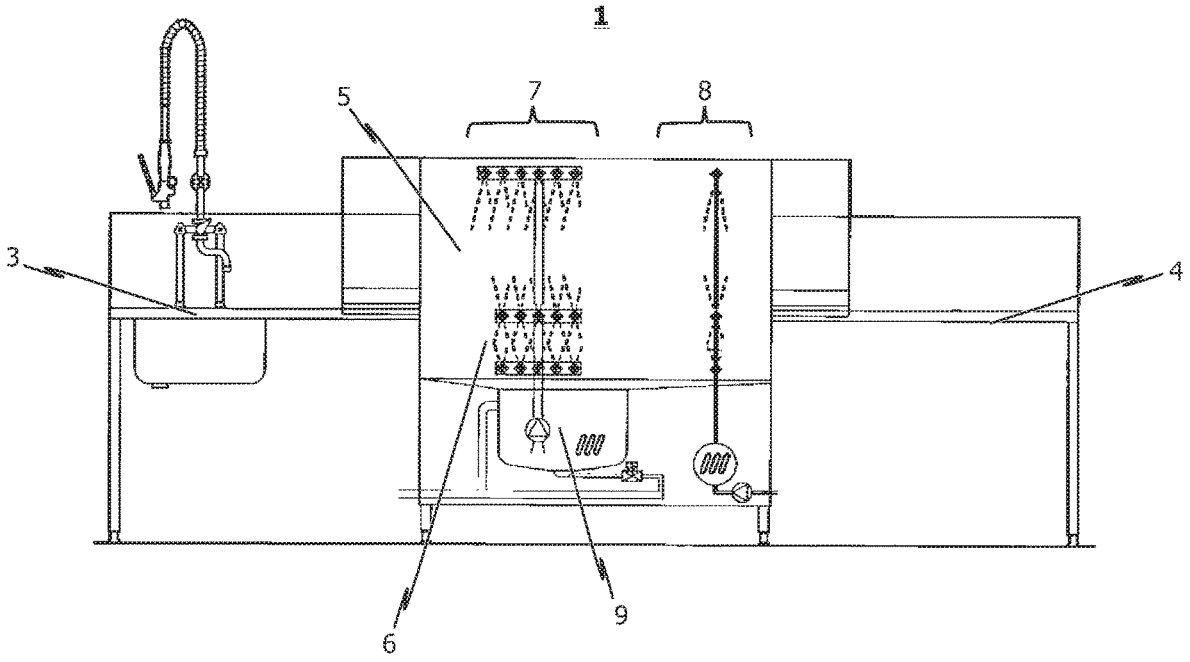
Figure 3:
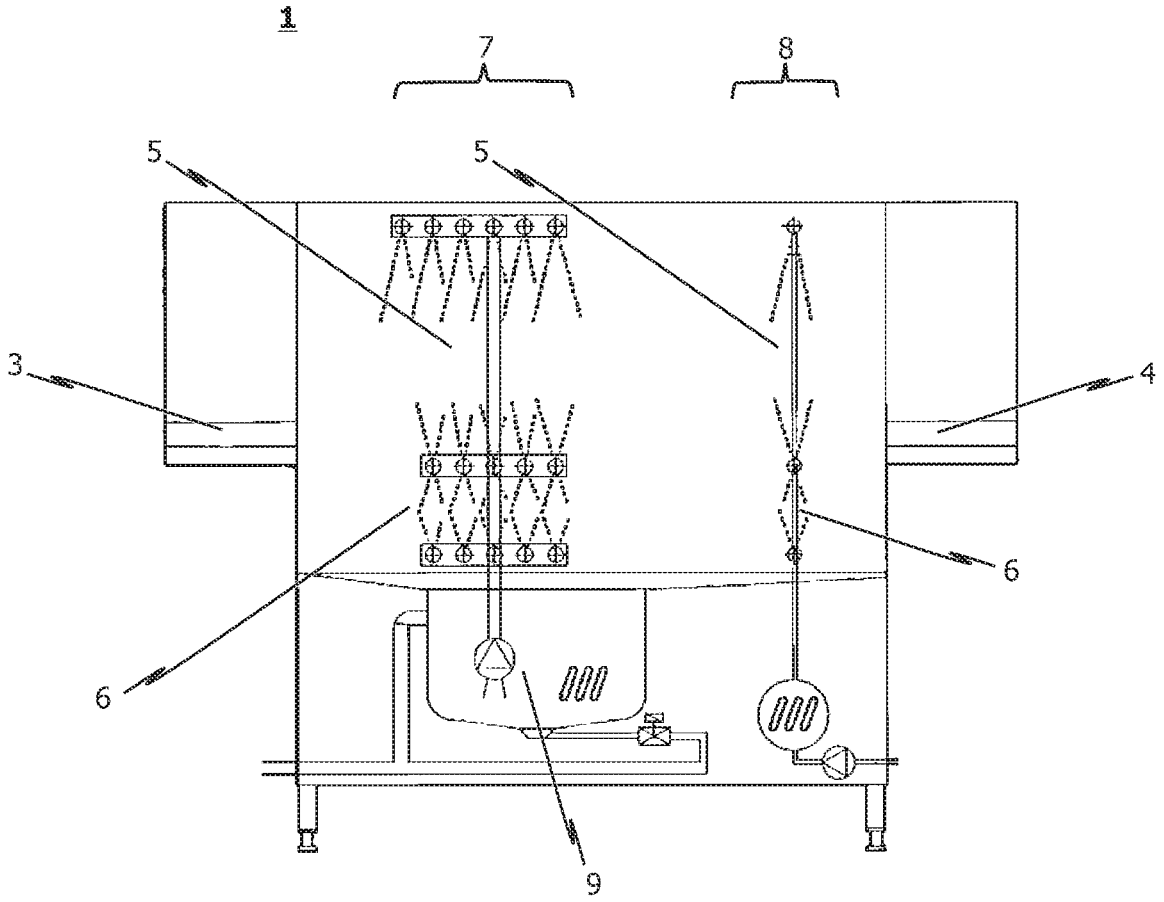

In contrast, in the case of the embodiments which are shown in FIGS. 2 to 5, it is provided to provide a different washing plane and, in particular, washing planes arranged above and/or below in the region of the washing zone 7. Here, as indicated in FIGS. 2 and 3, for example, it is conceivable that the two washing planes (main washing plane 5 and additional washing plane 6) are assigned a common washing system, to be precise, insofar as a common washing pump is provided for supplying the washing nozzles of the main washing zone 7 and the additional washing zone 7. Here, the suction side of the common washing pump opens into the common washing tank 9, whereas, on the pressure side of the (common) washing pump, the washing liquid line systems are connected to the corresponding washing arms which have the corresponding nozzles which spray the washing liquid into the main washing plane 5 and additional washing plane 6.

In this context, it is conceivable if a common washing arm is provided between the main washing plane 5 and the additional washing plane 6, which common washing arm has nozzles (washing nozzles) which are oriented both upward in the direction of the main washing plane and downward in the direction of the additional washing plane 6.

In the case of said exemplary embodiments, it is conceivable, in particular, to provide a higher number of washing nozzles which spray washing liquid into the additional washing plane 6, in comparison with a number of washing nozzles which spray washing liquid in the direction of the main washing plane 5.

It is also conceivable to equip the upper washing arm of the main washing plane 5 with a higher number or a lower number of washing nozzles in comparison with the washing nozzles of the lower washing arm which has the washing nozzles which spray washing liquid into the additional washing plane 6.

As an alternative to this, it is fundamentally also conceivable, however, to assign each washing plane a dedicated washing system with a dedicated washing pump which can be actuated independently of one another and dedicated washing arms, in order for it to be possible for the treatment parameters to be changed individually in the washing planes.

Figure 4:
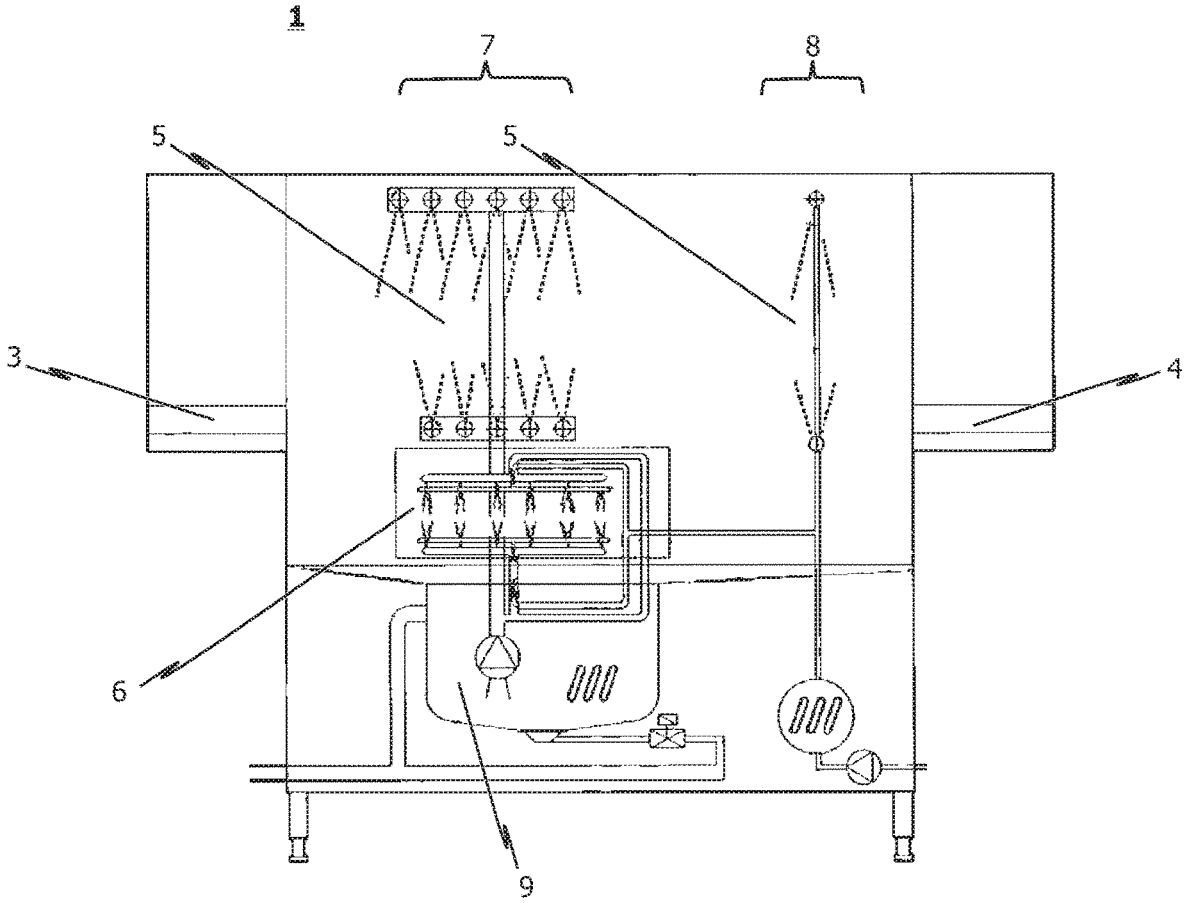

In contrast, FIG. 4 shows an embodiment of the conveyor dishwashing machine 1, in which the additional washing plane 6 below the main washing plane 5 has the functional principle of a programmable machine.

In commercial dishwashing, the term "programmable machine" is to be understood to mean a dishwashing machine 1, in the case of which the wash items to be treated (for example, placed in at least one wash basket) remain in a stationary manner during the entire treatment, that is to say, in particular, during the washing phase and final rinse phase.

In other words, in the case of the embodiment which is shown in FIG. 4, the wash items which are to be treated in the additional washing plane 6 or the wash baskets which are to be treated in the additional washing plane 6 are not transported through the washing zone 7 and final rinse zone 8 by the transport apparatus of the conveyor dishwashing machine 1; rather, the wash basket which is inserted into the additional washing plane 6 or the corresponding wash items is/are cleaned and rinsed completely in a stationary manner in said additional washing plane 6.

It is conceivable here if the additional washing plane 6 can be loaded and/or unloaded with the wash items to be treated via a separate opening.

Here, the additional washing plane 6 should preferably be of hermetically sealed configuration with respect to the main washing plane 5 which is provided above the additional washing plane 6, in order to prevent it being possible for the washing liquid which is sprayed in the main washing plane 5 to pass into the region of the additional washing plane 6 and, in particular, into the region of the wash items which are received there.

The additional washing plane 6 and the main washing plane 5 of the embodiment which is shown diagrammatically in FIG. 4 share a common washing pump if the washing phase is carried out in the additional washing plane 6. For this purpose, two washing liquid line systems are connected on the pressure side of the common washing pump, namely a first washing liquid line system which leads to the washing nozzles which are assigned to the main washing plane 5, and a second washing liquid line system which leads to washing arms or washing nozzles which are assigned to the additional washing plane 6. The second washing liquid line system can optionally be connected or disconnected in flow terms to the pressure side of the common washing pump via a valve (not shown in FIG. 4) or a device of the like.

In addition, the additional washing plane 6 is assigned a final rinse system which is configured separately from the final rinse zone 8. Said final rinse system has final rinse nozzles and a final rinse line system, via which final rinse liquid can be fed to the final rinse nozzles of the additional washing plane 6 as required, that is to say during a final rinse phase in the additional washing plane 6. In this context, it is conceivable if the final rinse liquid system which is assigned to the additional washing plane 6 is connected or can be connected as required in flow terms to the final rinse system which is assigned to the final rinse zone 8 of the conveyor dishwashing machine 1. In this context, it would be conceivable, in particular, if the final rinse liquid line system which is assigned to the additional washing plane 6 can be connected in flow terms to the final rinse liquid line system of the washing zone 7 of the conveyor dishwashing machine 1 via a corresponding valve device (not shown in FIG. 4).

Figure 5:
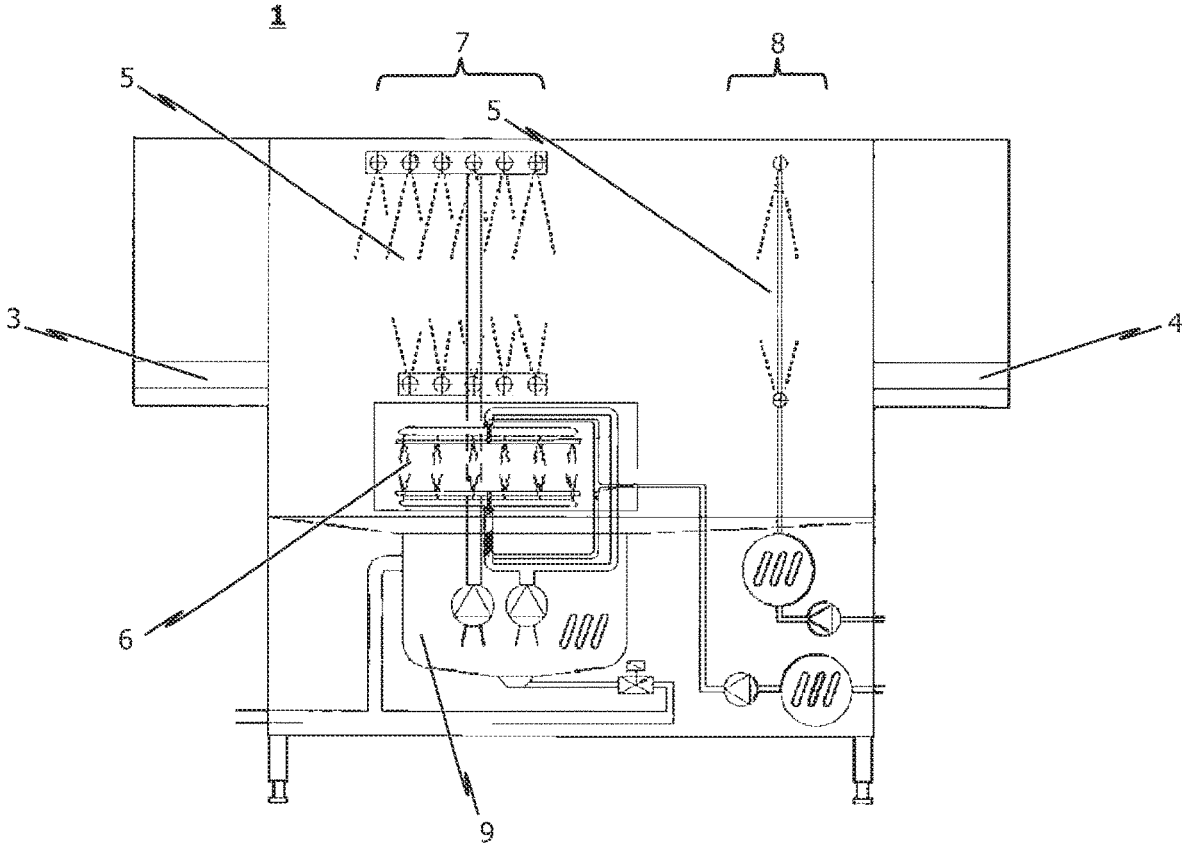

FIG. 5 shows one development of the embodiment which is shown diagrammatically in FIG. 4. The additional washing plane 6 also operates here in accordance with the functional principle of a programmable machine, that is to say wash items which are received in the additional washing plane 6 remain in a stationary manner during their treatment.

In the case of the embodiment which is shown in FIG. 5, in contrast to the embodiment which is shown diagrammatically in FIG. 4, the additional washing plane 6 is assigned a separate washing system, that is to say a dedicated washing pump, the pressure side of which is connected exclusively only to the washing nozzles of the additional washing plane 6, whereas the other washing pump serves exclusively to feed washing liquid to the spray nozzles which are assigned to the main washing plane 5.

In the case of the embodiment which is shown in FIG. 5, it is also provided to assign a separate final rinse system to the additional washing plane 6. Said separate final rinse liquid system has a separate final rinse pump or a separate water heater (boiler), with the result that the wash items which are received in the additional washing plane 6 can be finally rinsed there independently of the final rinse operation in the final rinse zone 8 of the conveyor dishwashing machine 1.

It goes without saying that combinations of the above-mentioned embodiments are also conceivable, in particular a washing and final rinse pump with a common middle washing arm and/or a common washing pump with separate washing arms and/or separate washing pumps and separate washing arms.

The liquid which is sprayed in the final rinse zone 8 of the conveyor dishwashing machine 1 and the final rinse liquid which is sprayed during the final rinse phase in the additional washing plane 6 can be fresh water or fresh water which is mixed with final rinse agent. In contrast, the washing liquid contains cleaning agent which is preferably metered automatically into the liquid which is contained in the washing tank 9 by a cleaning agent metering apparatus.

A control device controls the washing pumps and final rinse pump/pumps and the cleaning agent solution pump in a manner which is dependent on cleaning programs which are selected in each case on the control device by an operator. At least one cleaning program is provided, and a plurality of optionally selectable cleaning programs are preferably provided.

It can be seen from the hydraulic diagrams which are shown in the drawings that the at least one final rinse pump is connected by way of its suction side to an outlet of a boiler. Furthermore, the boiler has an inlet which is connected to a fresh water feed line, via which either fresh water or fresh water with final rinse agent metered into it is fed to the boiler. In the boiler, the liquid which is fed in via the inlet (pure fresh water or fresh water with final rinse agent metered into it) is heated according to the specification of a process sequence. Via the final rinse pump which is connected by way of its suction side to the boiler outlet, the final rinse liquid which is heated in the boiler can be fed to the corresponding final rinse nozzles, for example, during a fresh water final rinse phase of the additional washing plane 6 or continuously in the final rinse zone 8. It goes without saying that it is also conceivable that pure fresh water is fed to the boiler via the inlet via the fresh water feed line, into which pure fresh water a final rinse agent is metered after heating in the boiler.

In summary, it can be seen accordingly that the solution according to the invention provides at least one additional washing plane, to be precise, in particular, for wash items, for example, such as cutlery or GN containers, which wash items are as a rule relatively heavily soiled and therefore require a longer or special treatment. In this way, the washing performance can be improved by way of extension, for example, of the program duration of the additional washing zone 7, to be precise as is necessary for the wash item type which is to be treated in the washing zone 7, in order to ensure a perfect washing result. In addition to this, the capacity of the main washing plane 5 is not influenced negatively and is not reduced, despite the use, for example, of an intensive program in the additional washing plane 6.

The invention is not restricted to the exemplary embodiments which are shown by way of example in the drawings, but rather results from a synopsis of all features and aspects which are disclosed herein.

What is claimed is:

1. A conveyor dishwashing machine, comprising:

at least one washing zone, in which washing liquid is sprayed or can be sprayed onto the wash items to be treated in the conveyor dishwashing machine, and at least one final rinse zone which is connected downstream, as viewed in a transport direction of the wash items through the dishwashing machine, of the at least one washing zone and in which final rinse liquid is sprayed or can be sprayed onto the wash items to be treated in the conveyor dishwashing machine, and at least one drying zone which is connected downstream, as viewed in the transport direction, of the at least one final rinse zone and in which the wash items to be treated in the conveyor dishwashing machine are dried or can be dried at least partially;

wherein the conveyor dishwashing machine includes a transport apparatus for transporting the wash items through the washing zone, the final rinse zone and drying zone in such a way that the wash items are situated at least in regions in a washing plane which runs horizontally, wherein the washing plane which runs horizontally is configured as a main washing plane, and wherein, in addition to the main washing plane, there is at least one additional washing plane above or below at least one of the washing zone or the final rinse zone wherein wash items, which are located in the at least one additional washing plane, can be treated at the same time as wash items in the main washing plane.

2. The conveyor dishwashing machine as claimed in claim 1, the conveyor dishwashing machine being configured in such a way that wash items can be treated in the main washing plane and in the at least one additional washing plane at the same time and in parallel, but with different treatment parameters.

3. The conveyor dishwashing machine as claimed in claim 2, wherein the treatment parameters include one or more of an exposure time, a mechanical washing action, a mechanical rinse action, a temperature, or a chemical composition of a liquid.

4. The conveyor dishwashing machine as claimed in claim 1, further comprising:

an infeed table and an outlet table;

wherein the main washing plane lies in a horizontal plane in which both the infeed table and the outlet table also lie.

5. The conveyor dishwashing machine as claimed in claim 1, the conveyor dishwashing machine being configured in such a way that wash items can be fed to the main washing plane and the at least one additional washing plane via a common opening, and/or in such a way that wash items can be removed from the main washing plane and the at least one additional washing plane via a common opening.

6. The conveyor dishwashing machine as claimed in claim 1, the main washing plane being assigned an opening, via which wash items can be fed to and/or removed from the main washing plane, and the at least one additional washing plane being assigned a separate opening from the opening of the main washing plane, such that the main washing plane and the at least one additional washing plane can be loaded and/or unloaded independently of one another.

7. The conveyor dishwashing machine as claimed in claim 1, the at least one washing zone being assigned a washing system with a washing tank and a washing pump for feeding washing liquid which has collected in the washing tank to washing nozzles which are directed onto the main washing plane and to washing nozzles which are directed onto the at least one additional washing plane simultaneously and as required; and/or the at least one final rinse zone being configured as a pump final rinse zone which is assigned a final rinse system with a final rinse tank and a final rinse pump for feeding final rinse liquid which has collected in the final rinse tank to final rinse nozzles which are directed onto the main washing plane and to final rinse nozzles which are directed onto the at least one additional washing plane as required and/or at the same time; and/or the at least one final rinse zone being configured as a fresh water final rinse zone, in which final rinse liquid which is composed substantially of fresh water, into which a final rinse agent is possibly metered, can be fed as required and/or at the same time to fresh water final rinse nozzles which are directed onto the main washing plane and to fresh water final rinse nozzles which are directed onto the at least one additional washing plane.

8. The conveyor dishwashing machine as claimed in claim 1, wherein the additional washing plane is below the main washing plane, wherein the main washing plane is within a first treatment region and the additional washing plane is within a second treatment region, wherein the first treatment region is hermetically sealed with respect to the second treatment region, wherein the first treatment region is assigned a first treatment system with a first circulating pump that feeds to first spray nozzles of the first treatment region, and the second treatment region is assigned a second treatment system with a second circulating pump that feeds to second spray nozzles of the second treatment region, so as to enable independent treatment operations in the first treatment region and the second treatment region.

9. The conveyor dishwashing machine as claimed in claim 1, the at least one additional washing plane lying in a plane which is spaced apart vertically from the main washing plane, the at least one additional washing plane lying above or below the main washing plane, as viewed in the horizontal direction.

10. The conveyor dishwashing machine as claimed in claim 1, wherein the transport apparatus is a first transport apparatus, wherein a second transport apparatus is assigned to the at least one additional washing plane, for transporting wash items such that the wash items are situated at least in regions in the at least one additional washing plane.

11. The conveyor dishwashing machine as claimed in claim 1, wherein at least one of the washing zone or the final rinse zone is configured, in relation to the at least one additional washing plane, as a stationary treatment zone, in which wash items which are situated at least in regions in the at least one additional washing plane can be treated in a stationary manner.

12. The conveyor dishwashing machine as claimed in claim 1, at least part of the treatment parameters, with which wash items which are situated at least in regions in the main washing plane can be treated, being adjustable and corresponding to the treatment parameters of a standard treatment program, and at least part of the treatment parameters, with which wash items which are situated at least in regions in the at least one additional washing plane can be treated, being adjustable and differing from the treatment parameters of the standard treatment program.

13. The conveyor dishwashing machine as claimed in claim 12, at least part of the treatment parameters being adjustable automatically in a manner which is dependent on a wash item type or wash item group which is detected via a wash item detector apparatus.

14. The conveyor dishwashing machine as claimed in claim 1, the conveyor dishwashing machine having, furthermore, a loading and/or unloading apparatus for transferring wash items from a horizontal plane, in which the main washing plane also lies, into the at least one additional washing plane, and/or for transferring wash items from the additional washing plane into a horizontal plane, in which the main washing plane also lies.

15. A conveyor dishwashing machine comprising a chamber for receiving wares, the chamber having an inlet end, an outlet end and multiple treatment zones therein including at least one washing zone in which washing liquid is sprayed onto wash items to be treated, and at least one final rinse zone which is located downstream, as viewed in an item transport direction, of the at least one washing zone and in which final rinse liquid is sprayed onto wash items to be treated, the conveyor dishwashing machine having a transport apparatus for transporting the wash items through the treatment zones such that wash items are situated at least in regions in a main washing plane which runs horizontally, wherein at least one secondary washing plane is provided in at least one of the treatment zones, such that wash items, which are located in the secondary washing plane, can be treated in the secondary washing plane at the same time as wash items are treated in the main washing plane, wherein the secondary washing plane is located at a height that is above or below a height of the main washing plane, wherein the conveyor dishwashing machine is configured such that wash items can be treated in the main washing plane and in the secondary washing plane at the same time and in parallel, but with different treatment parameters.

16. The conveyor dishwashing machine as claimed in claim 15, wherein the different treatment parameters include one or more of an exposure time, a mechanical washing action, a rinse action, a temperature, a chemical composition of a washing liquid or a chemical composition of a rinse liquid.

17. The conveyor dishwashing machine as claimed in claim 15, wherein:

a common washing tank located below the secondary washing plane;

wherein the main washing plane is assigned a first treatment system with a first circulating pump that feeds from the common washing tank to first spray nozzles for spraying wash items in the main washing plane;

wherein the secondary washing plane is assigned a second treatment system with a second circulating pump that feeds from the common washing tank to second spray nozzles for spraying wash items in the secondary treatment plane, wherein the second circulating pump is configured to be operable independently of the first circulating pump.

18. The conveyor dishwashing machine as claimed in claim 17, wherein wash items to be treated in the main washing plane are fed to the treatment zones through an inlet opening in the inlet end and fed out of the treatment zones through an outlet opening in the outlet end;

wherein wash items to be treated in the secondary washing plane are loaded and unloaded through an opening that is separate from the inlet opening and the outlet opening.

19. The conveyor dishwashing machine as claimed in claim 18, wherein the main washing plane is within a first treatment region and the secondary washing plane is within a second treatment region, wherein the first treatment region is hermetically sealed with respect to the second treatment region.

20. The conveyor dishwashing machine as claimed in claim 19, wherein the second treatment region is a region in which wash items remain stationary during treatment.

21. The conveyor dishwashing machine as claimed in claim 17, wherein the main washing plane is assigned a first final rinse system for rinsing wash items in the main washing plane;

wherein the secondary washing plane is assigned a second final rinse system for rinsing wash items in the secondary treatment plane, wherein the second final rinse system is configured to be operable independently of the first final rinse system.

22. A conveyor dishwashing machine comprising a chamber for receiving wares, the chamber having an inlet end, an outlet end and multiple treatment zones therein including at least one washing zone in which washing liquid is sprayed onto wash items to be treated, and at least one final rinse zone which is located downstream, as viewed in an item transport direction, of the at least one washing zone and in which final rinse liquid is sprayed onto wash items to be treated, the conveyor dishwashing machine having a transport apparatus for transporting the wash items through the treatment zones such that wash items are situated at least in regions in a main washing plane which runs horizontally, wherein at least one secondary washing plane is provided in at least one of the treatment zones, such that wash items, which are located in the secondary washing plane, can be treated in the secondary washing plane at the same time as wash items are treated in the main washing plane, wherein the secondary washing plane is located at a height that is below a height of the main washing plane, wherein wash items to be treated in the main washing plane are fed to the treatment zones through an inlet opening in the inlet end and fed out of the treatment zones through an outlet opening in the outlet end; and wherein wash items to be treated in the secondary washing plane are loaded and unloaded through an opening that is separate from the inlet opening and the outlet opening.

* * * * *